US010111509B2

(12) United States Patent
Mehaddene et al.

(10) Patent No.: US 10,111,509 B2
(45) Date of Patent: Oct. 30, 2018

(54) EPILATOR

(71) Applicant: Braun GmbH, Kronberg (DE)

(72) Inventors: Tarik Mehaddene, Karben (DE); Frieder Grieshaber, Neu-Anspach (DE); Bernhard Kraus, Braunfels (DE)

(73) Assignee: Braun GMBH, Kronberg (DE)

( * ) Notice: Subject to any disclaimer, the term of this patent is extended or adjusted under 35 U.S.C. 154(b) by 148 days.

(21) Appl. No.: 15/379,550

(22) Filed: Dec. 15, 2016

(65) Prior Publication Data

US 2017/0172278 A1 Jun. 22, 2017

(30) Foreign Application Priority Data

Dec. 22, 2015 (EP) ..... 15202038
Dec. 5, 2016 (EP) ..... 16202096

(51) Int. Cl.
*A61B 17/50* (2006.01)
*A45D 26/00* (2006.01)

(52) U.S. Cl.
CPC ..... *A45D 26/0038* (2013.01); *A45D 26/0061* (2013.01)

(58) Field of Classification Search
CPC ... B26B 19/048; B26B 19/063; B26B 19/046; B26B 19/015; B26B 19/20; B26B 19/265; B26B 19/28; B26B 19/282; B26B 19/288; B26B 19/38; B26B 19/382; B26B 19/3846; B26B 19/3853; B26B 19/386; B26B 19/3873; B26B 19/388; B26B 19/02; B26B 19/14; B26B 19/48; A45D 26/0028; A45D 26/0023; A45D 26/0038; A45D 26/0061; A45D 2026/0095
See application file for complete search history.

(56) References Cited

U.S. PATENT DOCUMENTS

2005/0143755 A1 6/2005 Hashiguchi et al.
2008/0294176 A1 11/2008 Hashiguchi et al.
2011/0152884 A1 6/2011 Obkircher et al.

FOREIGN PATENT DOCUMENTS

FR 2823080 5/2003
JP 2001128728 5/2001

OTHER PUBLICATIONS

European search report dated Jun. 24, 2016.

*Primary Examiner* — Jonathan Miles
*Assistant Examiner* — Mohamed Gabr
(74) *Attorney, Agent, or Firm* — Ronald T. Sia; Kevin C. Johnson

(57) ABSTRACT

An epilator having a body and a plucking cylinder which is rotatable about a rotation axis for plucking hair. The plucking cylinder is movable with respect to the body between an extended position and a retracted position. Further, the epilator has elastically deformable elements biasing the plucking cylinder and at least two rollers mounted on the same side of the body as the plucking cylinder with the plucking cylinder interposed between the rollers. When pressing the rollers and the plucking cylinder to a flat surface the force exerted by the rollers exceeds the force exerted by the plucking cylinder.

16 Claims, 2 Drawing Sheets

EPILATOR

FIELD OF THE INVENTION

The present invention is concerned with an epilator for removing body hair. The epilator comprises a body or housing and a plucking cylinder which is rotatable about a rotation axis for plucking hair, especially a plucking cylinder having preferably pincer-like clamping elements for plucking hair when in contact with a user's skin. The epilator has the plucking cylinder mounted in or on the body such that the plucking cylinder is movable with respect to the body between an extended position and a retracted position. The epilator further comprises at least one elastically deformable element, for example a compression spring, a rubber-elastic element and/or a torsion spring, biasing the plucking cylinder into its extended position. Preferably, the biasing force exerted on the plucking cylinder is adjustable. The plucking cylinder is a component part of the epilator which is in direct contact with a user's skin and which rotates about the rotation axis. Typically, the rotation axis is at least substantially parallel to the user's skin during use of the epilator, i.e. during hair removal.

BACKGROUND OF THE INVENTION

An epilator is known e.g. from WO 2005/092142 A1. This apparatus comprises an electric motor as a drive unit which is coupled via a gearing to a plucking cylinder. Root hair removal using epilators causes a damage of the hair follicle and its neighboring tissue inducing a pain sensation. The fear of pain before the first epilation trial and the experienced pain after use are among the key barriers in converting new users into epilation.

Cooling of the skin and applying active mechanical stimulation onto it, e.g. vibrations, are the most used methods to reduce the pain caused by epilation. Whereas cooling acts on the peripheral nerve system by reducing the activity of pain receptors (nociceptors) in the skin, mechanical vibrations reduce the pain signal in the central nerve system (spiral cord, brain) by activating mechanical receptors in the skin. In EP 1 962 633 B1 it is suggested to provide a stimulation apparatus for stimulation the skin prior or after the treatment by a plucking cylinder of an epilator. The stimulation apparatus comprises rollers provided on either side of the plucking cylinder which rollers are provided with several protrusions.

Further, it is known that static pressure provides a well-being sensation and seems to relieve the sensation of pain. This effect is applied by some users by firmly pressing the plucking cylinder of an epilator in use to the skin. However, this has several detrimental effects which are mainly based on increased friction between the skin and the plucking cylinder, like increasing mechanical irritations of the skin, increasing current consumption and reduced effectivity of hair removal due to reduced revolution speed of the plucking cylinder.

It is an object of the present disclosure to provide an improved epilator avoiding drawbacks of known devices.

SUMMARY OF THE INVENTION

In accordance with one aspect of the present disclosure an epilator as defined above further comprises at least one roller arrangement having at least one further elastically deformable element and at least two rollers mounted on the same side of the body as the plucking cylinder with the plucking cylinder interposed between the rollers. The rollers are, e.g. individually or jointly, movable with respect to the body between an extended position and a retracted position, with the at least one further elastically deformable element biasing the rollers into the extended position. For example, the roller arrangement comprises two rollers, each having a separate elastically deformable element for individually moving each roller relative to the between the extended and retracted positions. Alternatively, the roller arrangement may comprise a frame supporting two or more rollers and having one or more elastically deformable elements for biasing the rollers, e.g. jointly, into the extended position.

The rollers, the plucking cylinder and the elastically deformable elements are arranged and adapted such that when pressing the rollers and the plucking cylinder to a flat surface, e.g. a portion of a user's skin, the force exerted by the rollers exceeds the force exerted by the plucking cylinder. That is, the sum of the biasing forces exerted by the at least one elastically deformable element of the rollers exceeds the sum of the biasing forces exerted by the at least one elastically deformable element of the plucking cylinder. Preferably, the biasing force exerted on the rollers is adjustable. In other words, the force generated in response to pressing the epilator to a surface, like a skin portion, is mainly reacted by the rollers. This has the effect that the epilator, despite the plucking cylinder being in close contact to the surface, does not suffer from the above mentioned detrimental effects which are based on increased friction between the skin and the plucking cylinder.

Further details and features of the invention may be obtained from the following description of embodiments in conjunction with the drawings.

DETAILED DESCRIPTION OF THE INVENTION

Figure 1A:
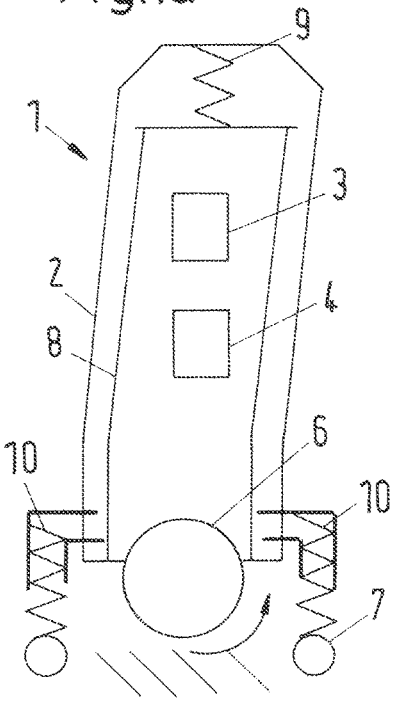
FIG. 1*a* shows in a schematic sectional view an epilator according to a first embodiment of the invention in an idle (extended) state.

Reducing the force exerted to the plucking cylinder during use of the epilator may be effected in that the resulting spring constant of the at least one elastically deformable element biasing the plucking cylinder into the extended position is smaller than the resulting spring constant of the at least one further elastically deformable element biasing the rollers into the extended position. In addition or as an alternative, the maximum movement of the rollers with respect to the body may be limited to be smaller than the maximum movement of the plucking cylinder with respect to the body.

In an unstressed condition of the elastically deformable elements a surface of the rollers facing away from the body may define a plane wherein the plucking cylinder is offset relative to this plane towards the body. In other words, the plucking cylinder and the rollers are mounted in or on the body such that in the extended idle state the rollers protrudes from the body further away by a given offset than the plucking cylinder in a direction perpendicular to the rotation axis.

Permitting the plucking cylinder to plunge into the body and/or to deflect from an idle position (extended position) results in an improved skin care. This allows the user to vary the plucking point, i.e. the angle of the epilator relative to the skin. Further, a better adaptation to different skin portions is possible. In addition, this allows for personal settings of the stimulation strength, i.e. a personalization of the epilator in use. The movement of the plucking cylinder from its extended position into the retracted position against the bias of the at least one elastically deformable element may also result in a reduction in the current consumption by reducing skin friction of plucking cylinder.

The movement of the epilator relative to the body preferably includes a plunging into the body and/or a deflection relative to the body. For example, the rotation axis of the plucking cylinder is displaceable with respect to the body in a direction perpendicular to the rotation axis. This may include guiding the rotation axis of the plucking cylinder, e.g. by mounting the rotational axis in at least one slide, preferably one slide guiding a bearing on either side of the axis. In addition or as an alternative, the rotation axis of the plucking cylinder may be tiltable with respect to the body about a tilting axis which is perpendicular to the rotation axis. In other words, plunging of the axis does not necessarily occur in an even manner with identical displacement on either side of the axis. In addition or as an alternative, the rotation axis of the plucking cylinder is preferably pivotable with respect to the body about a swiveling axis which is parallel to the rotation axis. In this respect, the rotation axis of the plucking cylinder may be mounted in at least one lever which is mounted pivotable with respect to the body about the swiveling axis.

The epilator may further comprise a drive unit for driving the plucking cylinder and, optionally, a battery, preferably a rechargeable battery, received within the body. The plucking cylinder may be mounted in or on the body such that the plucking cylinder is movable with respect to the drive unit (and, if provided, the battery) between the extended position and the retracted position. That is, it is mainly the plucking cylinder which moves while other component parts of the epilator are stationary within the body. As an alternative, the plucking cylinder may be mounted in or on the body such that the plucking cylinder is movable together with the drive unit (and, if provided, the battery) with respect to the body between the extended position and the retracted position. In other words, the plucking cylinder and further component parts of the epilator move together as a nit within the stationary body. In the latter case, the body may be an outer shell of the epilator guiding at least some of the component parts of the epilator which may be received in a further (inner) housing.

The epilator comprises at least two rollers, i.e. rotating and/or sliding elements, which are mounted on the same side of the body as the plucking cylinder, preferably one roller on either side of the plucking cylinder, for example to be rotatable about a respective axis which is, at least substantially, parallel to the rotation axis of the plucking cylinder in the extended position of the plucking cylinder. In other embodiments, the axis of the rollers may have a curved and/or bent configuration and/or may be flexible. The term roller is neither limited to a single rotatable drum nor to a series of individually movable rings nor to a mainly cylindrical design of the elements but may also comprise sliding elements of any suitable form. Provision of the rollers permits to make use of the above mentioned observation to relieve the pain sensation during epilation if the rollers are used to exert a pressure onto the skin.

The at least two rollers are movable with respect to the body between an extended position and a retracted position. Preferably, the epilator further comprises at least one elastically deformable element, for example a compression spring, a rubber-elastic element and/or a torsion spring, biasing the at least one roller into its extended position (idle position). The rollers can easily rotate around the spring-loaded axis. The at least two rollers may be displaceable with respect to the body in a direction perpendicular to the axis, tiltable with respect to the body about a tilting axis which is perpendicular to the axis and/or pivotable with respect to the body about a swiveling axis which is parallel to the axis. In other words, the rollers may move in a different manner compared with the stationary or movable plucking cylinder which may include a different spring travel and/or an inclined movement.

The pressing rollers, when compressed, support the skin in a way that the plucking cylinder comes with a relatively slight pressure in contact with the area of skin to be epilated. The friction between the plucking cylinder and the portion of skin underneath is reduced improving the skin care and reducing mechanical irritations. The plucking cylinder and/or the main body can be additionally spring-loaded allowing for a better adaptation to different skin portions, less friction and decrease in current consumption. Additionally, the flexibility of the plucking cylinder and the pressing rollers, which can be made of soft material, convey a softer sensation to the consumer compared to a firm and rigid construction. The plucking angle can be varied by the user by pressing unequally the front and the back rollers.

According to a further preferred embodiment, the rollers and the axis are mounted in or on the body in a way that a given offset in height between the pressing rollers and the plucking cylinder is ensured in the extended idle state, i.e. when the epilator is not in contact with skin. When the epilator is applied onto the skin, the pressing rollers come first in contact with the skin. Exerting a force on the epilator perpendicular to the skin is necessary to reduce the offset in height between the pressing rollers and the epilating cylinder and bring the tweezers in contact with the skin to grip the hairs and remove them from the skin. The force exerted by the user on the epilator is transmitted to skin through the, e.g. spring-loaded, rollers during compression. Thus, with one roller located on either side of the plucking cylinder, the skin is compressed before, during and after the hair removal process. The pressing rollers can roll passively on the skin or actively vibrate while they are compressing the skin to achieve even better pain reduction.

Two processes may explain why applied pressure on skin can help to reduce the pain sensation. On one side, the activation of the pressure sensors (SA slowly adapting) in the skin generates a "mechanical signal" and a tactile sensation which can activate the gate control path, weaken the pain signal and distracts the user from the unpleasant sensation of pain. On the other side, the mechanical compression of the nerves in the skin can reduce their radial dimension and affect the transport of the pain signal to the central nerve system. An extreme situation of such a nerve compression is for example encountered in Paresthesia. This is the sensation of an arm "fallen asleep" or "numbness" of the skin one may experience after a long sleep on a compressed arm.

The force exerted by the user on the epilator, required to bring the plucking cylinder in contact with the skin, can be adjusted by setting the offset in height between the pressing rollers and the plucking cylinder to the desired value. The higher the offset in the idle state is, the higher the pressure on skin during epilation. This point is important to address personal preferences. Users can show individual preferences regarding pressure on skin, they can consistently select the optimum stimulation strength according to their sensitivity and to the portion of skin to be epilated.

Preferably, the skin treatment apparatus further comprises at least one detector for detecting approximation of the plucking cylinder and/or rollers to the skin of a user or detecting contact of the plucking cylinder and/or rollers with the skin of a user. The detector is coupled to the control unit for transmitting a signal to the control unit. Further, the control unit is designed and arranged such that it controls activation of the drive unit and/or the plucking cylinder depending on the signal received from the detector. In other words, actuation of the plucking cylinder and/or rollers depends on whether or not the skin treatment apparatus is in contact with the skin of a user or at least close to contacting the skin of a user. For example, the springs acting on the plucking cylinder and/or the springs acting on the rollers can be used as contact-switches to close and open the electrical circuit and command the current delivery to the motor. The epilator is on when the springs are compressed (epilator on the skin) and turns off when they are released (epilator lifted up from the skin). Generally, the detector comprises at least one of a mechanical detector, a pressure sensor, a proximity sensor, a heat sensor and a contact sensor. In addition or as an alternative to the control unit switching the drive unit on and off, the control unit may tune the speed of the drive unit depending on the signal received from the detector(s).

According to an additional preferred embodiment, the epilator is provided with a detector comprising a sensor which is suitable for measuring the resistance to actuation of the plucking cylinder, e.g. by measuring the torque required for actuation of the plucking cylinder, and/or for measuring the current consumption of the drive unit, e.g. the motor. Preferably, the control unit is designed and arranged such that the at least one regulator increases the speed of the drive unit upon detection of an increased resistance and/or current consumption by the sensor and that the at least one regulator decreases the speed of the drive unit upon detection of an decreased resistance and/or current consumption by the sensor. In more detail, the control unit may comprise a rotational speed governor and may be provided with a control algorithm regulating the rotational speed of the drive unit to a predefined value, which may preferably be set as required, irrespective of influences on operating voltage or load. The control unit is preferably configured to increase and decrease the rotational speed of the drive unit depending on the load, e.g. torque. For example, the drive unit is initially tuned to a low speed, which may be too low for proper operation of the epilator, resulting in low current consumption and reduced noise. If the control unit detects a change in the load, the algorithm tunes the drive unit to a higher speed suitable for proper operation. As soon as the load drops below a threshold value, the algorithm tunes the drive unit back to the lower speed. The algorithm may use values like current consumption or battery voltage.

When using the apparatus in short strokes, an auto-modus may be inconvenient to the user due to switching on and switching off at frequent intervals. According to a preferred embodiment, a time delay is provided in a way that the apparatus keeps on running a short time after lifting it up from the skin. After the delay time is over, the apparatus turns off. In other words, the control unit may comprise a timer that is arranged such that the application device is driven by the drive unit for defined time span after detecting removal of the application device from the skin of a user.

Figure 1B:
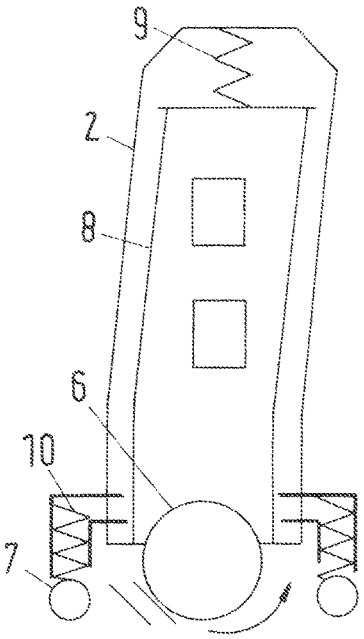
FIG. 1*b* shows the epilator of FIG. 1*a* in a retracted state.

In the embodiment of FIGS. 1*a* and 1*b*, an epilator 1 is shown comprising a body 2 or outer housing. A drive unit is provided within the body 2 comprising an, e.g. rechargeable, battery 3 and an electric motor 4. The electric motor 4 is coupled by a gearing 5 (cf. FIG. 2) to a plucking cylinder 6, i.e. an epilator drum with e.g. pincer-like clamping element for plucking and removing hair from a user's skin. The epilator 1 further comprises two stimulation elements 7 in the form of rollers provided on either side of the plucking cylinder 6. The plucking cylinder 6 and the rollers 7 are each supported in a rotatable manner about a respective axis (not shown) which extends perpendicular to the plane of the drawings, i.e. the axes are parallel to each other.

The plucking cylinder 6 and the drive unit are mounted on or in an inner housing 8 or frame. A compression spring 9 is located interposed between an inner surface of the body 2 and an outer surface of the inner housing 8 or frame permitting relative movement of the inner housing 8 or frame within the body 2. In other words, the inner housing 8 or frame may plunge into the body 2. FIG. 1*a* shows the inner housing 8 or frame with the plucking cylinder 6 in an extended idle state, i.e. when no external force is applied to the epilator 1. FIG. 1*b* shows the inner housing 8 or frame with the plucking cylinder 6 in a retracted state, i.e. when an external force is applied to the body 2 of epilator 1 which is reacted by the plucking cylinder 6, e.g. by contacting the user's skin.

In a similar manner, each of the rollers 7 is supported by a spring 10 biasing the respective roller 7 into its extended idle state as shown in FIG. 1*a*, while the rollers 7 may be individually displaced relative to the body 2 against the bias of spring 10 into a retracted state as shown in FIG. 1*b*. As can be taken from FIG. 1*a*, the rollers 7 and the plucking cylinder 6 are mounted in or on the body in a way that a given offset in height between the pressing rollers 7 and the plucking cylinder 6 is ensured in the extended idle state, i.e. when the epilator 1 is not in contact with skin as shown in FIG. 1*a*. When the epilator 1 is applied onto the skin, the pressing rollers 7 come first in contact with the skin. Exerting a force on the epilator 1 perpendicular to the skin is necessary to reduce the offset in height between the pressing rollers 7 and the plucking cylinder 6 and bring the tweezers in contact with the skin to grip the hairs and remove them from the skin. The force exerted by the user on the epilator 1 is transmitted to skin through the spring-loaded rollers 7 during compression. Thus, with one roller 7 located on either side of the plucking cylinder, the skin is compressed before, during and after the hair removal process. The pressing rollers 7 can roll passively on the skin or actively vibrate while they are compressing the skin to achieve even better pain reduction.

As an alternative to the embodiment shown in FIGS. 1*a* and 1*b* the plucking cylinder 6 and/or the rollers 7 may perform a swiveling movement relative to the body 2 when a force is applied to the body 2 and reacted by the plucking cylinder 6 and/or the rollers 7.

Figure 2:
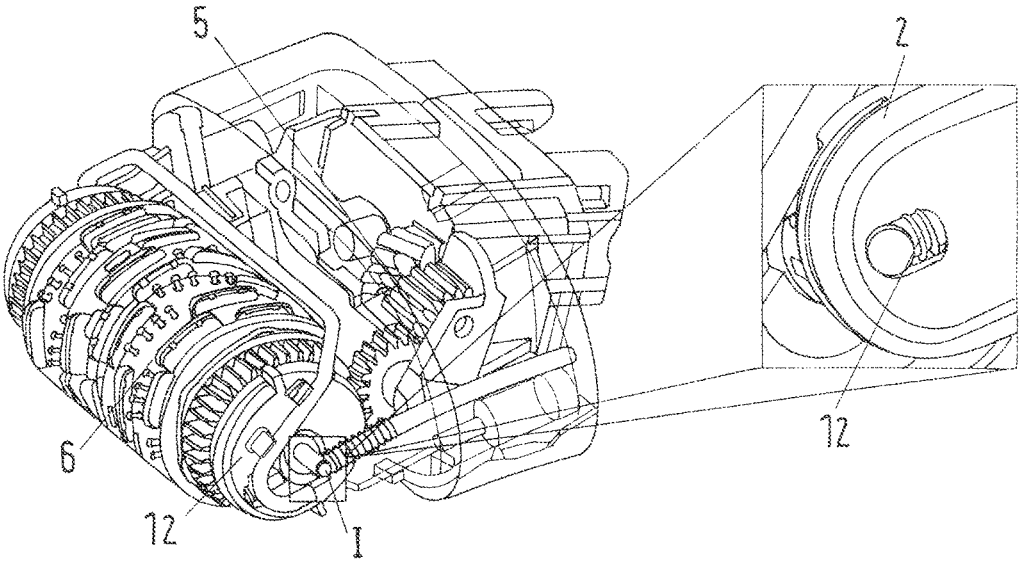
FIG. 2 shows a cut away view on an epilator according to a second embodiment of the invention.

FIG. 2 shows a further embodiment of an epilator 1 wherein the rollers 7 have been omitted in the drawing but may be provided if desired. In addition, FIG. 2 shows a different support of plucking cylinder 6 with respect to the outer housing or body 2. The rotation axis I of the plucking cylinder 6 is supported by bearings 11 on either side of the axis I. Each of the bearings 11 is mounted in the body 2 in a displaceable manner permitting the plucking cylinder 6 and its axis I to plunge at least partially into the body 2. A compression spring 12 is provided interposed between the body 2 and the respective bearing 11 of the axis I, thereby biasing the plucking cylinder into its idle extended state as shown in FIG. 2. When a force is exerted onto the epilator 1 which is reacted by the plucking cylinder 6, the plucking cylinder 6 is displaced relative to the body 2 against the bias of spring(s) 12 in a direction perpendicular to axis I.

Figure 3A:
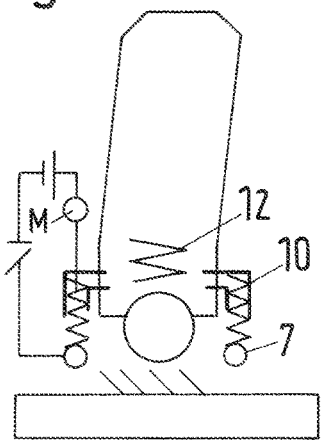
FIGS. 3*a*, 3*b* show a schematic sectional view of an epilator according to a third embodiment of the invention in a switched off state and a switched on state, respectively.
Figure 3B:
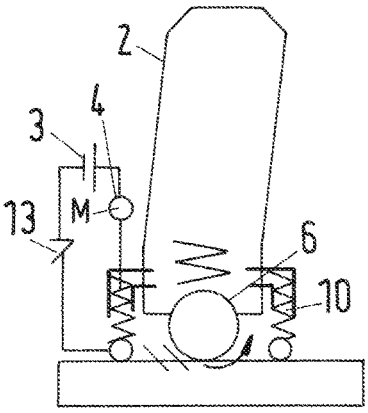

An alternative embodiment of an epilator 1 is depicted in FIGS. 3*a* and 3*b*. A portion of a user's skin is depicted as a flat surface against which the epilator may by pressed during use (as shown in FIG. 3*b*). In a similar manner as in the embodiment of FIGS. 1*a* and 1*b* rollers 7 are provided on either side of the plucking cylinder 6, which is mounted on or in the body 2 in a displaceable manner against the bias of spring 12 similar to the embodiment of FIG. 2. In addition, a switch 13 of a control unit is provided which is actuated by one of the rollers 7 acting as a detector. This results in the epilator 1 being switched off as long as the roller 7 (left roller in FIG. 3*a*) is not in contact with the skin. However, if the epilator 1 is pressed against the user's skin as shown in FIG. 3*b* such that the rollers 7 are axially displaced against the bias of springs 10 until the plucking cylinder 6 contacts the skin, the switch 13 is closed, thereby turning the epilator 1 on.

Figure 4A:
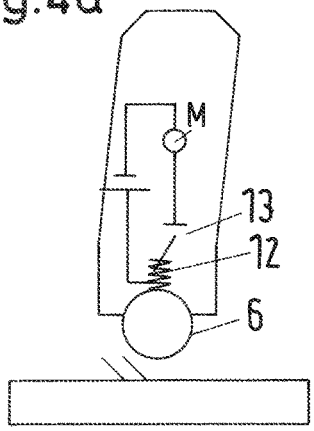
FIGS. 4*a*, 4*b* show schematic sectional views of an epilator according to a fourth embodiment of the invention in a switched off state and switched on state, respectively.
Figure 4B:
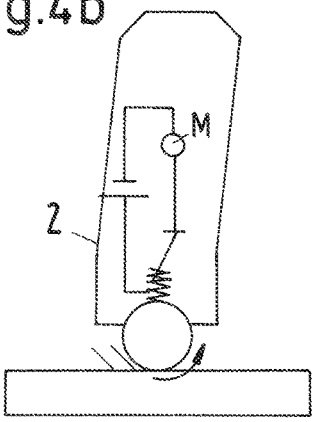

The embodiment depicted in FIGS. 4*a* and 4*b* shows a similar alternative wherein the plucking cylinder 6 is the detector which together with a transmission arm opens or closes switch 13, thereby turning the epilator 1 on and off depending on the pressure applied to a user's skin by plucking cylinder 6. Rollers 7 may be provided, e.g. as depicted in FIGS. 1*a* and 1*b* and FIGS. 3*a* and 3*b*.

Figure 5A:
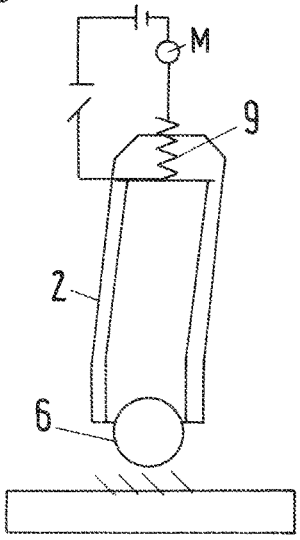
FIGS. 5*a*, 5*b* show in a schematic sectional view an epilator according to a fifth embodiment of the invention in a switched off state and a switched on state, respectively.
Figure 5B:
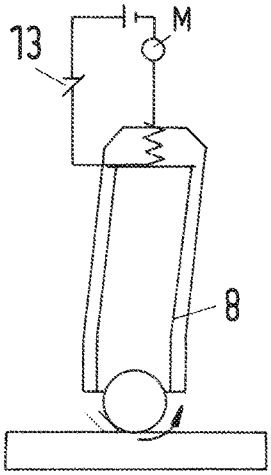

A still further alternative is depicted in the embodiment of FIGS. 5*a* and 5*b*. Again, rollers 7 may be provided, e.g. as depicted in FIGS. 1*a* and 1*b* and FIGS. 3*a* and 3*b*. In this embodiment the plucking cylinder 6 and component parts of the drive mechanism form a unit which is axially displaceable with respect to the body 2 of the epilator 1. Although the switch 13, the battery 3 and the electric motor 4 are indicated as being outside the body 2 in the schematic views of FIGS. 5*a* and 5*b*, these component parts may be provided within the body 2 of the epilator 1, preferably within the unit comprising the plucking cylinder 6 which is axially moveable with respect to the body 2. Again, the switch 13 is closed by pressing the plucking cylinder 6 onto the user's skin to thereby activate the epilator 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilator for removing body hair, the epilator comprising a body and a plucking cylinder which is rotatable about a rotation axis for plucking hair, wherein the plucking cylinder is mounted in or on the body such that the plucking cylinder is movable with respect to the body between an extended position and a retracted position, wherein the epilator further comprises at least one elastically deformable element biasing the plucking cylinder into the extended position, wherein the epilator further comprises at least one roller arrangement comprising at least one further elastically deformable element and at least two rollers mounted on the same side of the body as the plucking cylinder with the plucking cylinder interposed between the rollers, which rollers are movable with respect to the body between an extended position and a retracted position, with the further elastically deformable element biasing the rollers into the extended position, wherein the rollers, the plucking cylinder, and the elastically deformable elements are arranged and adapted such that when pressing the rollers and the plucking cylinder to a flat surface a force exerted by the rollers exceeds a force exerted by the plucking cylinder.

2. The epilator in accordance with claim 1, wherein the elastically deformable element is biasing the plucking cylinder with an adjustable biasing force.

3. The epilator in accordance with claim 1, wherein the elastically deformable elements have a resulting spring constant, and wherein the resulting spring constant of the at least one elastically deformable element biasing the plucking cylinder into the extended position is smaller than the resulting spring constant of the at least one further elastically deformable element biasing the rollers into the extended position.

4. The epilator in accordance with claim 1, wherein a maximum movement of the rollers with respect to the body is limited to be smaller than a maximum movement of the plucking cylinder with respect to the body.

5. The epilator in accordance with claim 1, wherein in an unstressed condition of the elastically deformable elements a surface of the rollers facing away from the body define a plane with the plucking cylinder being offset relative to this plane towards the body, the plucking cylinder and the at least one roller are mounted in or on the body such that in an extended idle state the at least one roller protrudes from the body further away by a given offset than the plucking cylinder in a direction perpendicular to the rotation axis.

6. The epilator in accordance with claim 5, wherein the rotation axis of the plucking cylinder is mounted in at least one slide.

7. The epilator in accordance with claim 6, wherein the axis of each roller is:

a. displaceable with respect to the body in a direction perpendicular to the axis, b. tiltable with respect to the body about a tilting axis which is perpendicular to the axis, c. is pivotable with respect to the body about a swiveling axis which is parallel to the axis, and wherein the control unit switches the drive unit on and off or tunes the speed of the drive unit, or a combination thereof.

8. The epilator in accordance with claim 1, wherein the rotation axis of the plucking cylinder is displaceable with respect to the body in a direction perpendicular to the rotation axis.

9. The epilator in accordance with claim 1, wherein the rotation axis of the plucking cylinder is tiltable with respect to the body about a tilting axis which is perpendicular to the rotation axis.

10. The epilator in accordance with claim 9, wherein the rotation axis of the plucking cylinder is mounted in at least one lever which is mounted pivotable with respect to the body about the swiveling axis.

11. The epilator in accordance with claim 1, wherein the rotation axis of the plucking cylinder is pivotable with respect to the body about a swiveling axis which is parallel to the rotation axis.

12. The epilator in accordance with claim 1, further comprising a drive unit for driving the plucking cylinder and, optionally, a battery, received within the body, wherein the plucking cylinder is mounted in or on the body such that the plucking cylinder is movable with respect to the drive unit between the extended position and the retracted position.

13. The epilator in accordance with claim 1, further comprising a drive unit for driving the plucking cylinder received within the body, wherein the plucking cylinder is mounted in or on the body such that the plucking cylinder is movable together with the drive unit with respect to the body between the extended position and the retracted position.

14. The epilator in accordance with claim 1, wherein the at least two rollers are rotatable about a spring-loaded axis, wherein the spring-loaded axis of each roller is:

a. displaceable with respect to the body in a direction perpendicular to the spring-loaded axis, b. tiltable with respect to the body about a tilting axis which is perpendicular to the spring-loaded axis, or c. pivotable with respect to the body about a swiveling axis which is parallel to the spring-loaded axis.

15. The epilator in accordance with claim 14, wherein the detector comprises at least one of a mechanical detector, a pressure sensor, a proximity sensor, a heat sensor, or a contact sensor.

16. The epilator in accordance with claim 1, further comprising a control unit for controlling movement of the plucking cylinder and at least one detector for detecting approximation or contact of the plucking cylinder or the rollers to or with the skin of a user, wherein the detector is coupled to the control unit for transmitting a signal to the control unit and wherein the control unit is designed and arranged such that it controls actuation of the plucking cylinder depending on the signal received from the detector.

* * * * *